US007918644B2

(12) United States Patent
Schreiber

(10) Patent No.: US 7,918,644 B2
(45) Date of Patent: Apr. 5, 2011

(54) AXIAL-FLOW COMPRESSOR FOR A GAS TURBINE ENGINE

(75) Inventor: Karl Schreiber, AM Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1035 days.

(21) Appl. No.: 11/730,441

(22) Filed: Apr. 2, 2007

(65) Prior Publication Data

US 2007/0231144 A1 Oct. 4, 2007

(30) Foreign Application Priority Data

Apr. 3, 2006 (DE) ..... 10 2006 015 838

(51) Int. Cl.
*F01D 1/02* (2006.01)

(52) U.S. Cl. ..... 415/199.5; 416/248

(58) Field of Classification Search ..... 415/173.1, 415/174.4, 174.5, 199.5; 416/248, 219 R
See application file for complete search history.

(56) References Cited

U.S. PATENT DOCUMENTS

| | | | | |
|---|---|---|---|---|
| 3,515,501 A | | 6/1970 | Palfreyman et al. | |
| 3,610,772 A | * | 10/1971 | Wagle | 416/8 |
| 3,610,777 A | * | 10/1971 | Wagle | 416/198 R |
| 3,625,634 A | * | 12/1971 | Stedfeld | 416/198 R |
| 3,813,185 A | | 5/1974 | Bouiller | |
| 3,966,523 A | * | 6/1976 | Jakobsen et al. | 156/169 |
| 4,191,510 A | | 3/1980 | Teysseyre et al. | |
| 4,397,609 A | | 8/1983 | Kochendorfer | |
| 5,400,505 A | | 3/1995 | Wei et al. | |
| 5,632,600 A | * | 5/1997 | Hull | 416/198 A |
| 6,213,720 B1 | * | 4/2001 | Farmer | 416/229 A |
| 6,250,883 B1 | | 6/2001 | Robinson | |
| 6,991,433 B2 | | 1/2006 | Mons | |
| 7,011,490 B2 | | 3/2006 | Albrecht | |
| 7,334,999 B2 | * | 2/2008 | Aumont et al. | 416/248 |
| 2005/0254950 A1 | * | 11/2005 | Mons | 416/201 R |

FOREIGN PATENT DOCUMENTS

| | | |
|---|---|---|
| CH | 497641 | 11/1970 |
| DE | 30 37 388 | 6/1982 |
| DE | 27 39 702 | 5/1987 |
| DE | 43 24 755 | 9/1994 |
| DE | 102 18 459 | 4/2002 |
| DE | 103 50 974 | 6/2005 |
| EP | I 406 019 A1 | 4/2004 |
| FR | 2 143 561 A1 | 2/1973 |
| GB | 1 173 834 A | 12/1969 |
| GB | 1 296 310 A | 11/1972 |

* cited by examiner

*Primary Examiner* — Edward Look
*Assistant Examiner* — Aaron R Eastman
(74) *Attorney, Agent, or Firm* — Timothy J. Klima; Shuttlesworth & Ingersoll, PLC

(57) ABSTRACT

An axial-flow compressor for a gas turbine engine has a rotor drum (2) in thermally lower loaded first compressor stages (3 to 6) which includes a one-piece ring, or rotor rings (7 to 10) attached to one another. Fiber belts (18, 21) are wound onto these rings close to the rotor blades and include carbon fibers embedded in a high-temperature resistant polymer matrix. As the rotor disks can be dispensed with, since their function will be assumed by the fiber belts, the compressor features low weight, requires limited space only, and, in addition, can be produced cost-effectively.

20 Claims, 1 Drawing Sheet

AXIAL-FLOW COMPRESSOR FOR A GAS TURBINE ENGINE

Figure 1:
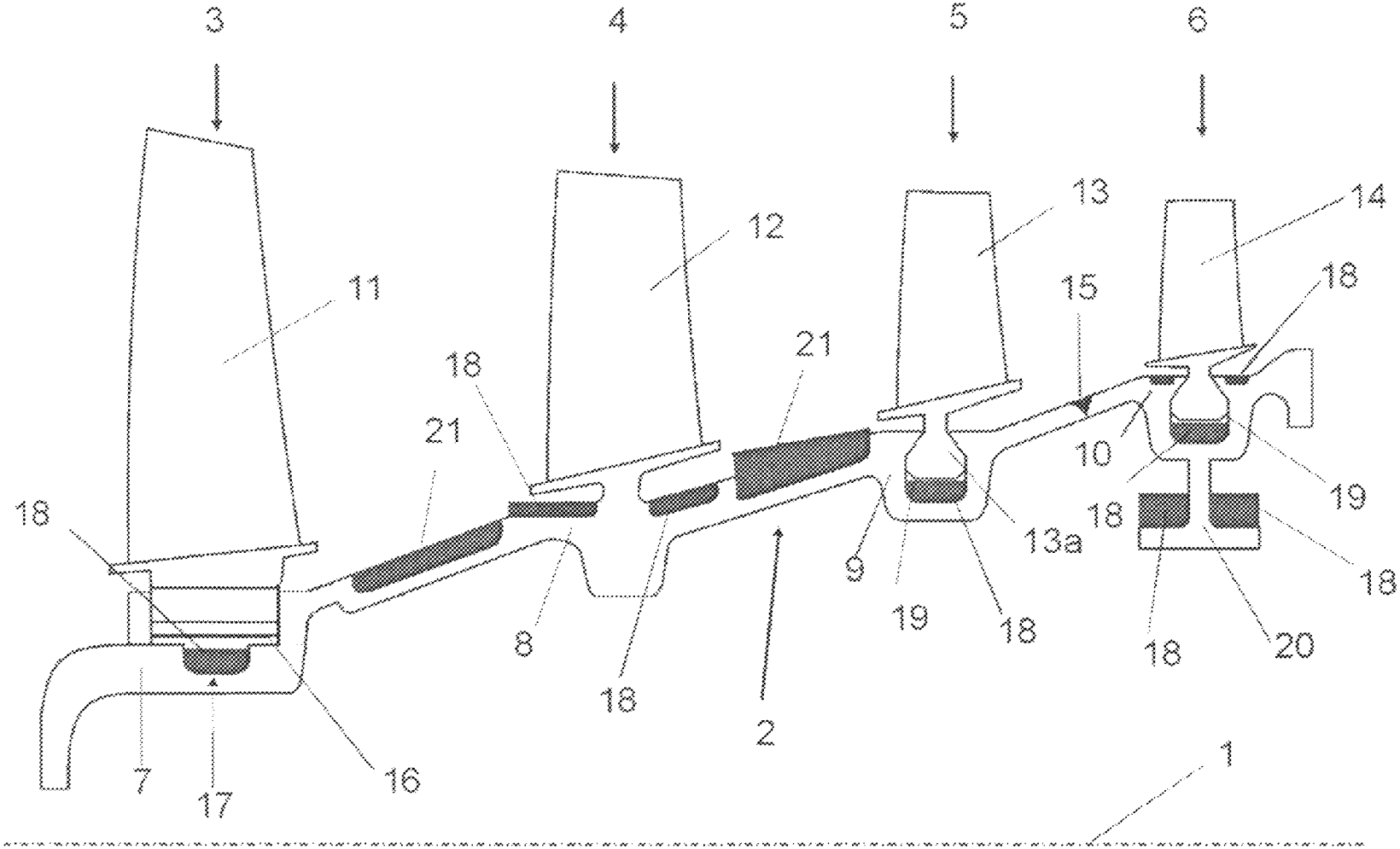

This application claims priority to German Patent Application DE10 2006 015 838.5 filed Apr. 3, 2006, the entirety of which is incorporated by reference herein.

This invention relates to an axial-flow compressor, more particularly, to a high-pressure compressor, an intermediate-pressure compressor or a low-pressure compressor for a gas turbine engine having a rotor drum driven by the turbine, with rotor blades disposed on an outer circumference of the rotor drum in the respective compressor stage, which are followed by stator vanes.

An axial-flow compressor includes one or several rotors comprising rotor blades arranged on the circumference of a shaft driven by the turbine and of a stator vane row downstream of the rotor in each compressor stage. In a compressor having several stages—each formed by a row of rotating blades and a row of stationary vanes—the individual rotors are combined to a drum, for example by welding. Except for the so-called "blisk", in which the blades are integrally formed onto the rotor shaft, the rotor blades are usually fixed in a common, circumferential slot on the circumference of the rotor shaft or in individual, axially disposed adjacent slots. The rotor blades, rotating at high speed and arranged on a hollow rotor shaft and, thus, at a certain distance from the center axis of the compressor, are subject to high centrifugal forces. The loading of the blades by centrifugal forces is counteracted by the disk-type construction of the rotor shaft whose major mass share is situated near the compressor axis. A suite of rotor disks is combined, on the periphery, to the above mentioned drum, preferably by welding.

The arrangement of the rotor disks required for the compensation of the centrifugal load is a major disadvantage of such a compressor as these disks significantly contribute to the total weight of the compressor, and ultimately of the engine, and also consume considerable installation space unavailable for other purposes. Finally, the material and manufacturing investment and, thus, the cost required by the rotor disks is high.

A broad aspect of the present invention is to provide a rotor for the compressor of a gas turbine engine, which, while featuring low weight, is producible with reduced cost effort.

It is a particular object of the present invention to provide a solution to the above problems by a rotor designed in accordance with the features described herein. Advantageous developments of the present invention will be apparent from the description below.

The present invention, in its essence, provides a design of the rotor or the rotor drum, respectively, with the rotor blades carried thereon, in the form of a rotor ring, dispensing with the conventional, space-consuming, heavy and costly rotor disks. Several rotor rings can be combined to a rotor drum by welding, threaded connection, other connection or can also form a one-piece rotor drum. To compensate the high centrifugal loads, fiber belts are wound onto the rotor ring or the rotor drum, respectively, which include carbon fibers enveloped by a high-temperature resistant polymer matrix, with the term high temperature here being understood as the respective component temperature occurring.

The space so gained in the interior of the rotor drum can favorably be used for the installation of a generator or other auxiliary equipment.

In a development of the present invention, the polymer matrix includes an epoxy resin which includes ester cyanide or polybisma-imide or polyamide-imide or another high-temperature resistant resin which at the same time prevents corrosion of the carbon fibers.

The fiber belts, which can be used with rotor blades carried in axial slots or in an annular slot as well as with rotor blades integrally formed onto the rotor ring or the rotor drum, respectively, are wound into a belt location groove provided beneath the axial slots or in a deepened annular slot or—in the case of integrally formed-on rotor blades—near the blade neck onto the rotor ring or into a groove provided in the rotor ring.

In the case of rotor blades fixed in axial slots or in an annular slot, additional fiber belts can be wound onto the rotor ring near the blade neck.

An extension provided with a location surface can be formed onto the inner surface of the rotor drum or the rotor ring, respectively, beneath the blade fixation. Further fiber belts can be wound onto this location surface.

In a further development of the present invention, an additional fiber belt can also be wound onto the area of the rotor drum downstream of the rotor blade row where the stator vanes of the compressor are situated. The belts for compensating the centrifugal forces can here also serve as a seal towards the stator vanes.

The carbon fibers—upon wetting with the polymer matrix—are wound onto the outer surface or into the grooves, respectively. They may also be wound in dry condition, in which case a polymer is subsequently infiltrated into the wound material. The polymer matrix materials can be both duromers and thermoplastics.

On a compressor for an engine, the fiber belts are preferably provided in the first four compressor stages, where the polymer matrix of the fiber belts is resistant to the temperatures occurring there. Upon availability of matrix materials resistant to higher temperatures, this type of construction may also be extended to other stages. In a further development of the present invention, the fibers have gradually increasing elasticity over the height of the fiber belt towards the rotor drum, to optimally compensate the forces and stresses occurring.

A higher polymer content near the rotor surface serves to compensate the forces exerted on the fibers by thermal expansion during the operation of the rotor drum. However, the fibers can also be wound onto a heated rotor drum and/or under reduced pre-load.

For "health monitoring", i.e. monitoring the condition of the rotor, piezo fibers can be integrated into the fiber belt which are connected to a sensor for resistance measurement.

An example of the present invention is more fully described in light of the accompanying drawing.

FIG. 1 shows a partial sectional view of a hypothetical rotor drum with different blade and fiber belt variants of a four-stage compressor.

Different fiber belt reinforcement embodiments are illustrated in the drawing, showing one and the same rotor drum 2 driven by a turbine and rotating around a center axis 1 in four stages of a compressor, however without stator vane rows being shown, the rotor drum 2 here being a hypothetical configuration for four different blade arrangements.

The individual compressor stages 3 to 6 of the rotor drum 2, each comprising a forged rotor ring 7 to 10 with rotor blades 11 to 14 disposed on its circumference, can be joined by a weld 15, here only shown between the rotor rings 9 and 10. However, as shown in the drawing, several rotor rings may preferably be forged in one piece to dispense with costly and failure-prone threaded connections or welded joints and increase the service life of the rotor drum 2 so made.

In a first embodiment, the rotor blades 11 of the first compressor stage 3 are each fixed in axial slots 16 provided on the circumference of the rotor ring 7. Beneath the axial slots 16, a circumferential belt location groove 17 is provided in the rotor ring 7 accommodating a fiber belt 18 consisting of carbon fibers embedded in high-temperature polymer.

In a second embodiment, the rotor ring 8 and the rotor blade 12 in the second compressor stage 4 form a one-piece rotor integrally manufactured like a blisk. In this example, fiber belts 18 are provided on the rotor ring 8 on either side of the blade root of the rotor blades 12 which can be wound directly onto the rotor ring 8 or into a circumferential groove of the rotor ring 8.

In the third embodiment of a rotor of the third compressor stage 5, a deepened annular slot 19 is provided in the rotor ring 9 which holds the blade root 13*a* of the rotor blade 13 and additionally accommodates in its bottom part, actually beneath the blade root 13*a*, a circumferential fiber belt 18 of carbon fibers embedded in a polymer matrix.

In a fourth embodiment of a rotor in the fourth compressor stage 6, the rotor ring 10 is again provided with a deepened annular slot 19 as per the third embodiment, but additionally includes fiber belts 18 applied to a Tee-shaped extension 20. In addition, further fiber belts 18 are applied to the rotor ring 10 as per the second embodiment.

A fifth embodiment is shown in those parts of the rotor drum 2 which are downstream of the rotor blades 11 and 12 and in which the stator vane rows (not shown) of the first and second compressor stage are situated. In this area of the rotor drum 2, i.e. the rotor rings 7/8 and 8/9, a further fiber belt 21 is arranged either flush or slightly protruding beyond the circumferential surface which may additionally serve as abradable seal between the rotor drum 2 and the stator vane tip edge. In addition, the fiber belts 21 may also be provided as slip rings and used for information transfer.

The fiber belts 18, 21 include carbon fibers which are applied into the belt location grooves 17 or the deepened annular slots 19 and/or onto the rotor rings 7 to 10 in a winding process and which—in agreement with the temperature occurring in the first four stages of a high-pressure compressor—are embedded in a polymer matrix with a heat resistance of up to 350° centigrade, here ester cyanide. The carbon fibers can be wound-on in wet condition—after wetting with polymer—or dry, with the polymer being infiltrated into the winding material after winding. In the case of a high-pressure compressor for a gas turbine engine, application of the fiber belts is restricted to the first stages where the temperatures occurring do not exceed the maximum permissible thermal loadability of the polymer matrix. It is intended that the invention include the use of polymer matrices having a resistance of greater than 350° C., when appropriate such polymers become available.

The fiber belts 18 are disposed in the area of the blade root, i.e. at the origin of forces and maximum stresses. The forces can immediately be taken up by the fiber belts—without the usually necessary disks.

With the stress input being larger on the inner side of the rotor rings 7 to 10 or the rotor drum 2, respectively, a gradual fiber built-up is applied for the reinforcing belts 18, 21 to account for the mechanical properties. This means, for example, that the carbon fibers will be applied with gradually increasing elasticity inwards, to the smaller winding radius, or gradually increasing stiffness outwards, to the larger winding radius, to compensate differences in stress input.

Thermal expansion of the metallic rotor rings 7 to 10 or the rotor drum 2, respectively, occurring during compressor operation is taken into account in the design of the reinforcing belts 18, 21 in that the fibers are wound either under reduced pre-load or onto a heated rotor drum. Furthermore, a first—soft—winding layer acting as compensator for the thermal expansion of the metallic rotor rings may be applied using a high thermoplastic content. Thus, the strength potential of the metallic rotor ring can be employed, and the stresses occurring need not be taken up at full by the fiber-material reinforcing belt.

In connection with the so-called "health monitoring", piezo fibers connected to a sensor (not shown) can be wound into the fiber belts 18, 21. A resistance change of the piezo fibers under elastic elongation detected by the sensor enables the integrity of the rotor rings to be monitored.

LIST OF REFERENCE NUMERALS

| | |
|---|---|
| 1 | Center axis of compressor |
| 2 | Rotor drum |
| 3 to 6 | First to fourth compressor stage |
| 7 to 10 | Rotor rings of rotor drum |
| 11 to 14 | Rotor blades |
| 13a | Blade root of rotor blade 13 |
| 15 | Weld |
| 16 | Axial slots |
| 17 | Belt location groove |
| 18 | Fiber belt |
| 19 | Deepened annular slot |
| 20 | Tee-shaped extension |
| 21 | Fiber belt/seal |

What is claimed is:

1. An axial-flow compressor, comprising:

a rotor drum driven by a turbine;

rotor blades disposed on an outer circumference of the rotor drum in respective compressor stages, which rotor blades are respectively followed by stator vanes;

a plurality of fiber belts positioned on the rotor drum in areas of maximum centrifugal load, the fiber belts including fibers wound onto the rotor drum and embedded in a high-temperature resistant polymer; and piezo fibers wound into the fiber belts, which are connectable to a sensor to detect resistance changes caused by changes of length of the piezo fibers to indicate a condition of the rotor drum.

2. An axial-flow compressor in accordance with claim 1, wherein the fiber belts are constructed of carbon fibers wound onto the rotor rings, with the polymer being an epoxy resin having a heat resistance of up to 350° centigrade, the polymer being applied by at least one of wet winding and subsequent infiltration of dry-wound carbon fibers.

3. An axial-flow compressor in accordance with claim 2, wherein the epoxy resin includes at least one of ester cyanide, polybisma-imide, polyamide-imide and another high-temperature resistant resin, to prevent corrosion of the carbon fibers.

4. An axial-flow compressor in accordance with claim 1, wherein the fiber belts are wound of different fiber materials, with an elasticity of the fiber material in the fiber belts increasing towards a location surface on the rotor drum.

5. An axial-flow compressor in accordance with claim 1, and further comprising:

a radially inner layer of a thermoplastic material, upon which the embedded fiber belts are wound, to act as a compressible compensator for the thermal expansion of the rotor drum.

6. An axial-flow compressor in accordance with claim 1, wherein the fiber belts are wound onto the rotor drum immediately in areas exposed to forces exerted by the rotor blades.

7. An axial-flow compressor in accordance with claim 6, and further comprising at least one belt location groove on the rotor drum for accepting the wound fiber belts, provided beneath a-respective blade retention axial slots.

8. An axial-flow compressor in accordance with claim 7, and further comprising a Tee-shaped extension on an inner side of the rotor drum beneath at least one row of rotor blades with fiber belts wound onto free location surfaces of the Tee-shaped extension.

9. An axial-flow compressor in accordance with claim 6, and further comprising a blade retention annular slot on the rotor drum, the wound fiber belts being positioned in this slot beneath the blade roots.

10. An axial-flow compressor in accordance with claim 9, and further comprising additional fiber belts wound onto the rotor drum on at least one side of the rotor blades.

11. An axial-flow compressor in accordance with claim 1, wherein the rotor blades are integrally formed onto the rotor drum and the fiber belts are wound on a groove of the rotor drum.

12. An axial-flow compressor in accordance with claim 1, wherein at least one fiber belt wound onto the rotor drum downstream of a respective row of rotor blades also serves as an abradable seal for an opposing row of stator vanes.

13. An axial-flow compressor in accordance with claim 1, wherein the rotor drum and respective wound fiber belts have an annular configuration.

14. An axial-flow compressor, comprising:

a rotor drum driven by a turbine;

rotor blades disposed on an outer circumference of the rotor drum in respective compressor stages, which rotor blades are respectively followed by stator vanes;

a plurality of fiber belts positioned on the rotor drum in areas of maximum centrifugal load, the fiber belts including fibers wound onto the rotor drum and embedded in a high-temperature resistant polymer;

wherein the fiber belts are wound of different fiber materials, with an elasticity of the fiber material in the fiber belts increasing towards a location surface on the rotor drum.

15. An axial-flow compressor in accordance with claim 14, and further comprising additional fiber belts wound onto the rotor drum on at least one side of the rotor blades.

16. An axial-flow compressor in accordance with claim 14, and further comprising a Tee-shaped extension on an inner side of the rotor drum beneath at least one row of rotor blades with fiber belts wound onto free location surfaces of the Tee-shaped extension.

17. An axial-flow compressor in accordance with claim 14, and further comprising at least one belt location groove on the rotor drum for accepting the wound fiber belts, provided beneath respective blade retention axial slots.

18. An axial-flow compressor in accordance with claim 14, and further comprising a blade retention annular slot on the rotor drum, the wound fiber belts being positioned in this slot beneath the blade roots.

19. An axial-flow compressor in accordance with claim 14, wherein the rotor blades are integrally formed onto the rotor drum and the fiber belts are wound on a groove of the rotor drum.

20. An axial-flow compressor, comprising:

a rotor drum driven by a turbine;

rotor blades disposed on an outer circumference of the rotor drum in respective compressor stages, which rotor blades are respectively followed by stator vanes;

a plurality of fiber belts positioned on the rotor drum in areas of maximum centrifugal load, the fiber belts including fibers wound onto the rotor drum and embedded in a high-temperature resistant polymer;

a radially inner layer of a thermoplastic material, upon which the embedded fiber belts are wound, to act as a compressible compensator for the thermal expansion of the rotor drum.

* * * * *